US007398972B2

(12) United States Patent
Schuller et al.

(10) Patent No.: US 7,398,972 B2
(45) Date of Patent: Jul. 15, 2008

(54) PLASTIC CARD REORIENTING MECHANISM AND INTERCHANGEABLE INPUT HOPPER

(75) Inventors: Peter D. Schuller, Coon Rapids, MN (US); Bryan D. B. Hoeve, Farmington, MN (US); Mark J. Sobania, Ham Lake, MN (US)

(73) Assignee: DataCard Corporation, Minnetonka, MN (US)

( * ) Notice: Subject to any disclaimer, the term of this patent is extended or adjusted under 35 U.S.C. 154(b) by 606 days.

(21) Appl. No.: 10/716,579

(22) Filed: Nov. 17, 2003

(65) Prior Publication Data

US 2005/0104281 A1 May 19, 2005

(51) Int. Cl.
*B65H 29/00* (2006.01)

(52) U.S. Cl. ..... 271/185; 271/186; 271/65

(58) Field of Classification Search ..... 271/186, 271/185, 65; 399/401; 400/188; 347/104, 347/218; 403/377, 335, 336
See application file for complete search history.

(56) References Cited

U.S. PATENT DOCUMENTS

| | | | | |
|---|---|---|---|---|
| 3,744,614 | A * | 7/1973 | Shooter et al. | 198/404 |
| 5,203,553 | A | 4/1993 | Chiang | |
| 5,337,134 | A | 8/1994 | Sato et al. | |
| 5,426,283 | A | 6/1995 | Berthozat et al. | |
| 5,699,601 | A * | 12/1997 | Gilliam et al. | 29/278 |
| 5,762,431 | A | 6/1998 | Pawelka et al. | |
| 5,768,143 | A | 6/1998 | Fujimoto | |
| 5,771,058 | A | 6/1998 | Kobayashi | |
| 5,806,999 | A | 9/1998 | Kobayashi | |
| 5,886,726 | A | 3/1999 | Pawelka et al. | |
| 5,927,713 | A * | 7/1999 | Driscoll et al. | 271/298 |
| 6,279,901 | B1 | 8/2001 | Fulmer | |
| 6,296,246 | B1 * | 10/2001 | Boorsma | 271/186 |
| 6,315,283 | B1 | 11/2001 | Haas et al. | |
| 6,318,914 | B1 * | 11/2001 | Cuo et al. | 400/188 |
| 6,431,537 | B1 | 8/2002 | Meier | |
| 6,536,758 | B2 | 3/2003 | Meier et al. | |
| 6,942,213 | B2 * | 9/2005 | Endo et al. | 271/186 |
| 2002/0127043 | A1 | 9/2002 | McCue, Jr. et al. | |

FOREIGN PATENT DOCUMENTS

| | | | |
|---|---|---|---|
| JP | 2001-122479 | A | 5/2001 |
| WO | WO 03/089251 | A1 | 10/2003 |

OTHER PUBLICATIONS

Manual, "Quick help hp deskjet 9xx series," XP-002319443, pp. 1-116 (2000).
Office Action issued Jan. 18, 2008 by the State Intellectual Property Office of the People'Republic of China and English translation thereof.

* cited by examiner

*Primary Examiner*—David H Bollinger
(74) *Attorney, Agent, or Firm*—Hamre, Schumann, Mueller & Larson, P.C.

(57) ABSTRACT

A card reorienting mechanism and an input hopper of plastic card processing equipment, for example a desktop plastic card printer. The card reorienting mechanism is a modular unit that permits the entire mechanism to be inserted or removed as a single unit from the printer. In addition, the input hopper is designed as an interchangeable system that permits alteration in the card capacity of the hopper.

14 Claims, 16 Drawing Sheets

PLASTIC CARD REORIENTING MECHANISM AND INTERCHANGEABLE INPUT HOPPER

FIELD OF THE INVENTION

The invention relates to plastic card processing equipment, particularly desktop processing equipment, that perform at least one processing operation on a plastic card, such as a credit card, driver's license, identification card and the like. More particularly, the invention relates to a mechanism for reorienting a plastic card within card processing equipment. In addition, the invention relates to an interchangeable input hopper assembly for use with plastic card processing equipment.

BACKGROUND OF THE INVENTION

The use of card processing equipment for processing plastic cards is well known. In such equipment, a plastic card to be processed is input into the processing equipment, at least one processing operation is performed on the input card, and the card is then output from the processing equipment. The processing operation(s) performed on the plastic card by known processing equipment includes one or more of printing, laminating, magnetic stripe encoding, programming of a chip embedded in the card, and the like.

The processing equipment is often configured in the form of a desktop unit which, to limit the size of the unit, typically perform only one processing operation on the plastic card, although the equipment may perform multiple card processing operations. An example of a popular desktop plastic card processing unit is a desktop plastic card printer which performs monochromatic or multi-color printing on a card that is input into the printer. Examples of desktop units that perform printing are disclosed in U.S. Pat. Nos. 5,426,283; 5,762,431; 5,886,726; 6,315,283; 6,431,537; and 6,536,758. Of these, U.S. Pat. No. 5,426,283 describes a unit that performs chip programming in addition to printing.

In plastic card desktop printers, the print mechanism is typically limited to printing on only one side of the plastic card at any one time. In order to permit printing on both sides of the card, some desktop printers include a duplex mechanism or reorienting mechanism that flips the card 180 degrees after the card has been printed on one side and the card is then returned to the printing mechanism to print on the opposite side of the card. Examples of desktop printers that include a duplex mechanism for flipping a card 180 degrees are disclosed in U.S. Pat. Nos. 5,806,999; 5,771,058; 5,768,143; and 6,279,901.

Moreover, many desktop plastic card processing units are configured to process a single card at any one time. Therefore, the processing of the card must be finished, and then the card output from, or nearly output from, the unit before processing can begin on the next card. However, to avoid the need to feed each card by hand into the desktop unit, the unit typically includes some form of card input hopper which holds a number of cards and which is configured to feed the cards one-by-one into the unit.

There is a continuing need for improvements to the reorienting mechanisms and to the input hoppers of plastic card processing equipment.

SUMMARY OF THE INVENTION

The invention relates to improvements to plastic card processing equipment, for example a desktop plastic card printer.

More particularly, the invention relates to improvements to a card reorienting mechanism and to an input hopper of plastic card processing equipment, for example a desktop plastic card printer.

In one aspect of the invention, a reorienting mechanism of a plastic card processing machine, for example a desktop plastic card printer, is designed as a modular unit that can be quickly and easily connected both mechanically and electrically to the remainder of the processing machine. The modular reorienting mechanism facilitates assembly and reduces assembly costs. Further, the modular design permits easy reconfiguration of the card processing machine, permitting the reorienting mechanism to be removed if the customer requires processing on only one side of the card, or permitting the reorienting mechanism to be added to the machine if the customer requires reorienting of the cards.

Additional features of the reorienting mechanism, which can be implemented together with the modularity concept, or separately from that concept, include:

A) a fastenerless assembly where no screws, bolts, or rivets are used to connect any element of the reorienting mechanism to the reorienting mechanism, or to connect the reorienting mechanism itself to the remainder of the card processing machine;

B) the use of a wrap spring, separate from the clutch mechanism, to provide one-way rotation for the reorienting device;

C) a member integrally formed with the chassis of the reorienting mechanism for biasing the clutch mechanism of the reorienting mechanism;

D) a self-loading design for the nip rollers of the reorienting device that eliminates the need for springs; and E) a calibrating feature built into the reorienting mechanism for calibrating the rotation of the reorienting device.

In another aspect of the invention, an interchangeable input hopper system for use with plastic card processing equipment, for example a desktop plastic card printer, is provided. The hopper system is designed to permit a quick and easy change in the capacity of the of cards being held for input into the processing equipment, by exchanging one input hopper assembly for another input hopper assembly that is capable of holding a smaller or larger maximum number of the same type of cards. Each input hopper assembly can be quickly mounted in operative position on the processing equipment. In this interchangeable version, the entire hopper assembly is replaced with a different hopper assembly.

As an alternative interchangeable input hopper system, the input hopper assembly is provided with a hopper chassis. A number of differently sized input hopper shells are designed to removably connect to the hopper chassis, so as to form with the chassis a number of differently sized input hoppers for holding differing maximum amounts of the same type of cards. By replacing one input hopper shell with another differently sized input hopper shell, the size of the input hopper can be changed.

In one implementation of the input hopper system, one input hopper is designed to hold a maximum of 100 of one size of cards for processing, while a second input hopper is designed to hold a maximum of 200 of the same size cards as the first input hopper for processing. It is to be realized that the input hoppers could be designed to hold other maximum amounts of cards if desired.

For a better understanding of the invention, and its advantages, reference should be made to the drawings which form a further part hereof, and to the accompanying description, in which there is described an exemplary implementation of the invention.

DETAILED DESCRIPTION OF THE INVENTION

The invention relates to plastic card processing equipment for processing data bearing plastic cards, such as credit cards, driver's licenses, identification cards, loyalty cards and the like. A specific implementation of the concepts of the invention will be described in detail with respect to a desktop plastic card printer that performs printing, either monochromatic or multi-color, on plastic cards. However, the inventive concepts described herein could also be implemented on other types of plastic card processing equipment that perform other types of card processing functions either in addition to, or separate from, printing. Other card processing operations include laminating one or more sides of a card, encoding a magnetic stripe on the card, programming a chip embedded in the card, and other types of card processing known in the art.

In addition, the phrase "plastic card" will be used to describe the substrate that is being processed. However, the inventive concepts described herein can be used in the processing of other substrates that are formed of materials other than plastic, for example paper. Further, the inventive concepts will be described with respect to printing on CR80 size plastic cards. However, it is to be realized that the concepts described herein could be used in other card sizes as well.

Figure 1:
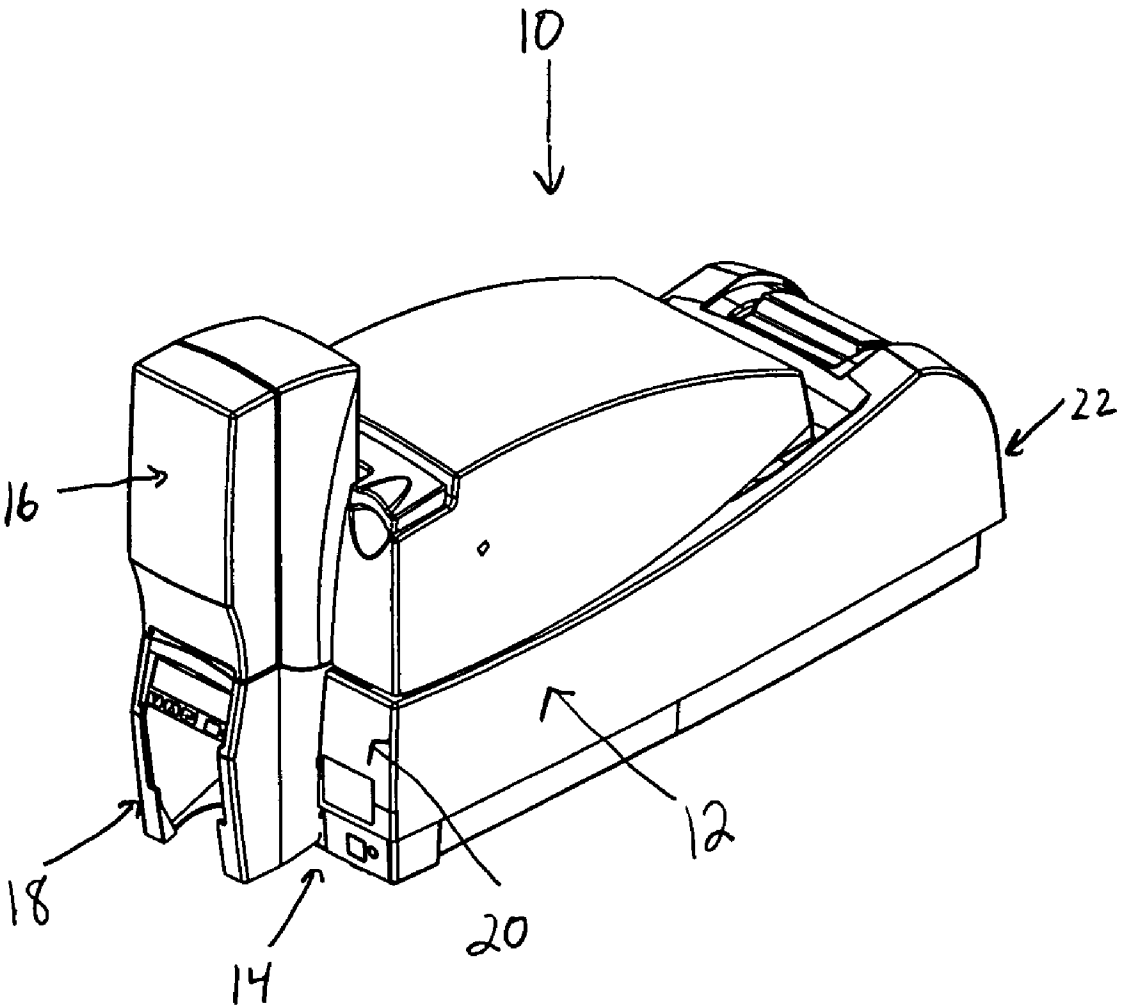
FIG. 1 is a perspective view of a desktop plastic card printer employing the reorienting mechanism and the interchangeable input hopper system of the invention.

With reference to FIG. 1, a desktop plastic card printer 10 is illustrated. The printer 10 includes a housing 12 having an input/output end 14 with an input hopper assembly 16 adjacent the input/output end 14 for feeding cards into the printer to be printed by a print mechanism 15 within the printer (see FIG. 3), and an output hopper assembly 18 for receiving printed cards from the printer. The print mechanism 15 is preferably a thermal print mechanism. A suitable thermal print mechanism is disclosed in U.S. Pat. Nos. 5,762,431 and 5,886,726, each of which is incorporated herein by reference.

For convenience in describing the figures, the input/output end 14 of the printer will be described as being at a front end region 20 of the housing 12 while the opposite end of the housing 12 will be referred to as a back end region 22.

As described in more detail in U.S. Pat. Nos. 5,762,431 and 5,886,726, in operation of the printer, a card is fed from the input hopper assembly 16 into the printer. The card is transported via suitable transport mechanisms to the print mechanism which performs a desired printing operation on one side of the card. After printing is complete, the printed card is transported back to the input/output end 14 where the card is deposited into the output hopper assembly.

The printers disclosed in U.S. Pat. Nos. 5,762,431 and 5,886,726 are configured to print on only side of the card. One way to print on the opposite side of the card is to manually re-feed the card back into the printer after the printing is complete on one side of the card. Another way to print on the opposite side of the card is to provide a duplex mechanism within the printer that automatically flips the card 180 degrees after printing is completed on one side of the card. After the card is flipped, it is then transported back to the print mechanism to print on the opposite side of the card.

Card Reorienting Mechanism

Figure 2:
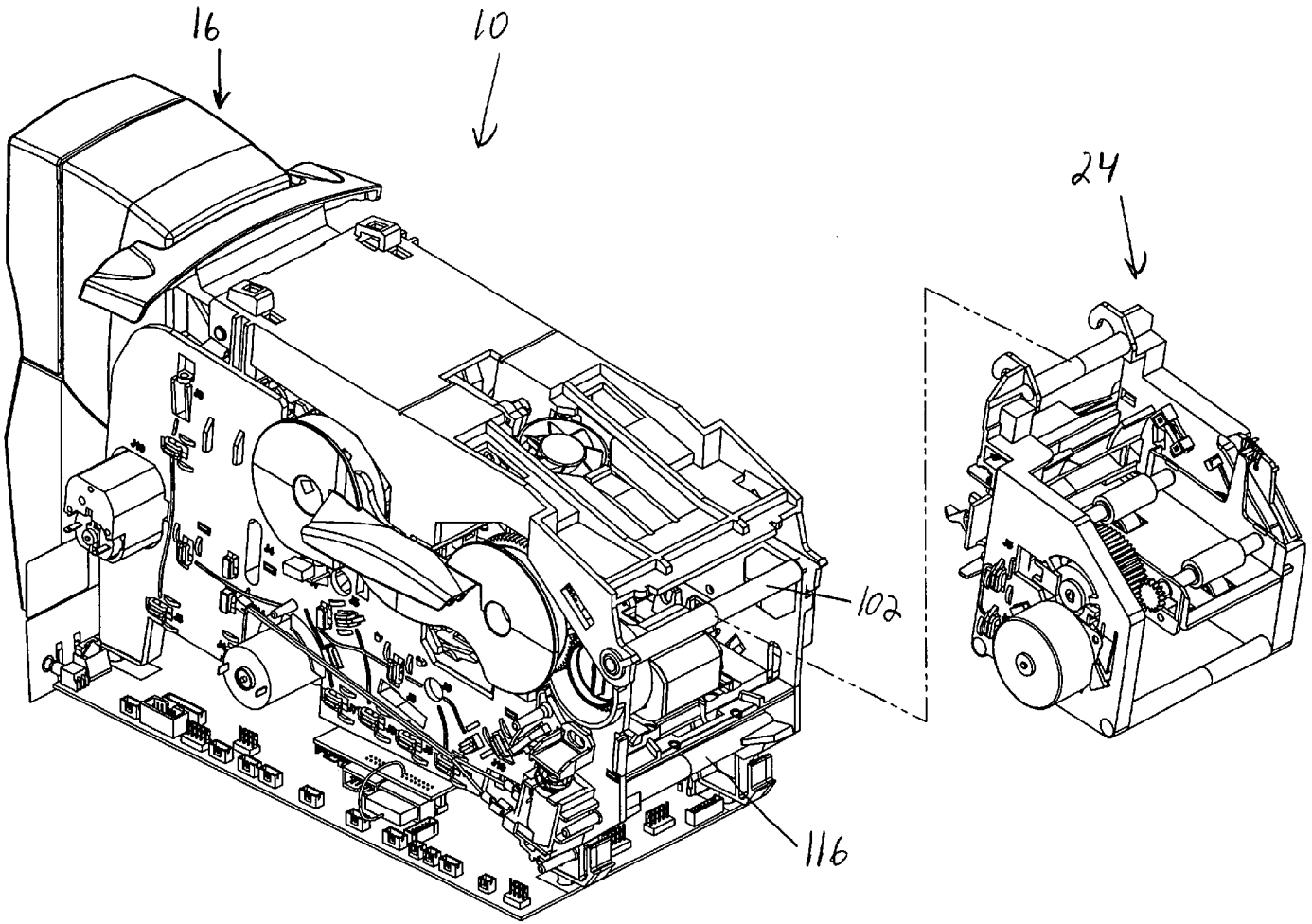
FIG. 2 is another perspective view of the printer, with the printer housing removed, and showing the intended location of the reorienting mechanism relative to the remainder of the printer.
Figure 3:
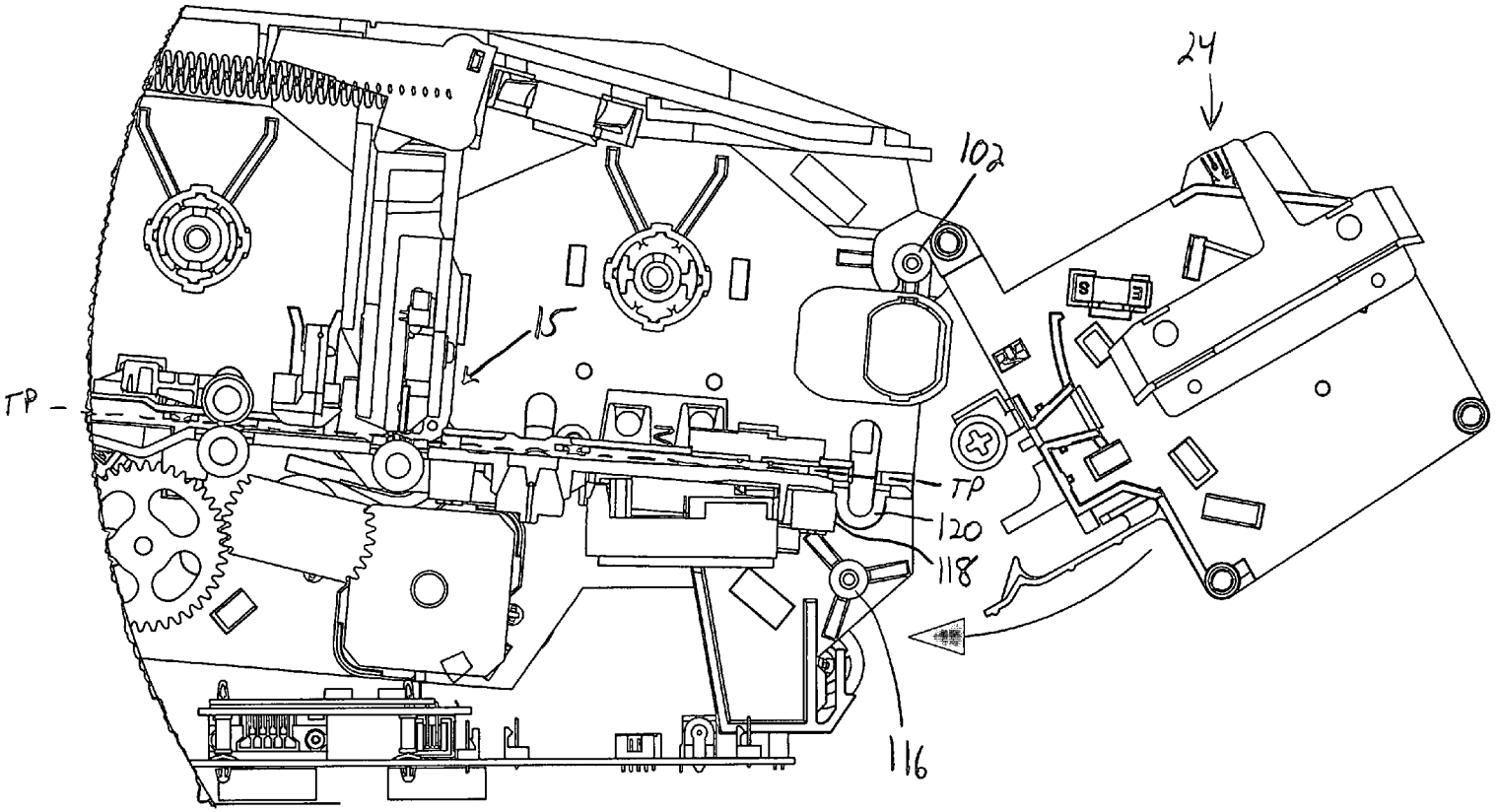
FIG. 3 is a side view of a portion of the rear of the printer illustrating how the reorienting mechanism is assembled into the printer.

The printer 10 is configured to have a duplex mechanism 24 to permit printing on opposite sides of the card. The duplex mechanism 24 is illustrated in FIGS. 2 and 3 as being positioned at the back end region 22 of the housing 12. The duplex mechanism 24 is designed to flip a card 180 degrees after one side of the card is printed to enable the opposite side of the card to be printed. In addition to flipping a card 180 degrees, the duplex mechanism 24 is able to reposition the card at any angle relative to the primary card travel path through the printer 10. A portion of the travel path through the printer is indicated by the line TP in FIG. 3. Hereinafter, the mechanism 24 will be described as a reorienting mechanism which encompasses reorienting a card 180 degrees, as well as reorienting the card to any angle relative to the card travel path.

The reorienting mechanism 24 is designed as a modular mechanism in which the entire mechanism 24 is insertable and removable as a single unit into and from the printer 10, and all elements necessary for the operation of the mechanism 24, except for electrical power and command signals, are integrated into the mechanism 24. In addition, the mechanism 24 is connected to the printer by a fastenerless mechanism, and the mechanism 24 itself is a fastenerless assembly. By fastenerless, Applicants mean that no screws, bolts, or rivets are used to connect the mechanism 24 to the printer, or to interconnect any elements of the mechanism 24. The modular construction, along with the lack of fasteners, facilitates assembly of the mechanism 24 itself, and facilitates assembly of the mechanism into the printer, thereby reducing assembly costs.

Details of the mechanism 24 will now be described with reference to FIGS. 2-13. With reference initially to FIG. 5, the mechanism 24 includes a chassis 30 that is formed by two chassis halves 30*a*, 30*b* that are connected together by stand-offs 32*a*, 32*b* on the chassis halves 30*a*, 30*b*. The ends of the stand-offs 32*b* are each designed with a reduced diameter section configured to snap fit connect into corresponding receiving holes formed in the ends of the stand-offs 32*a*. The stand-offs 32*a*, 32*b* are formed on, and extend toward each other from, chassis plates 34*a*, 34*b*.

Figure 5:
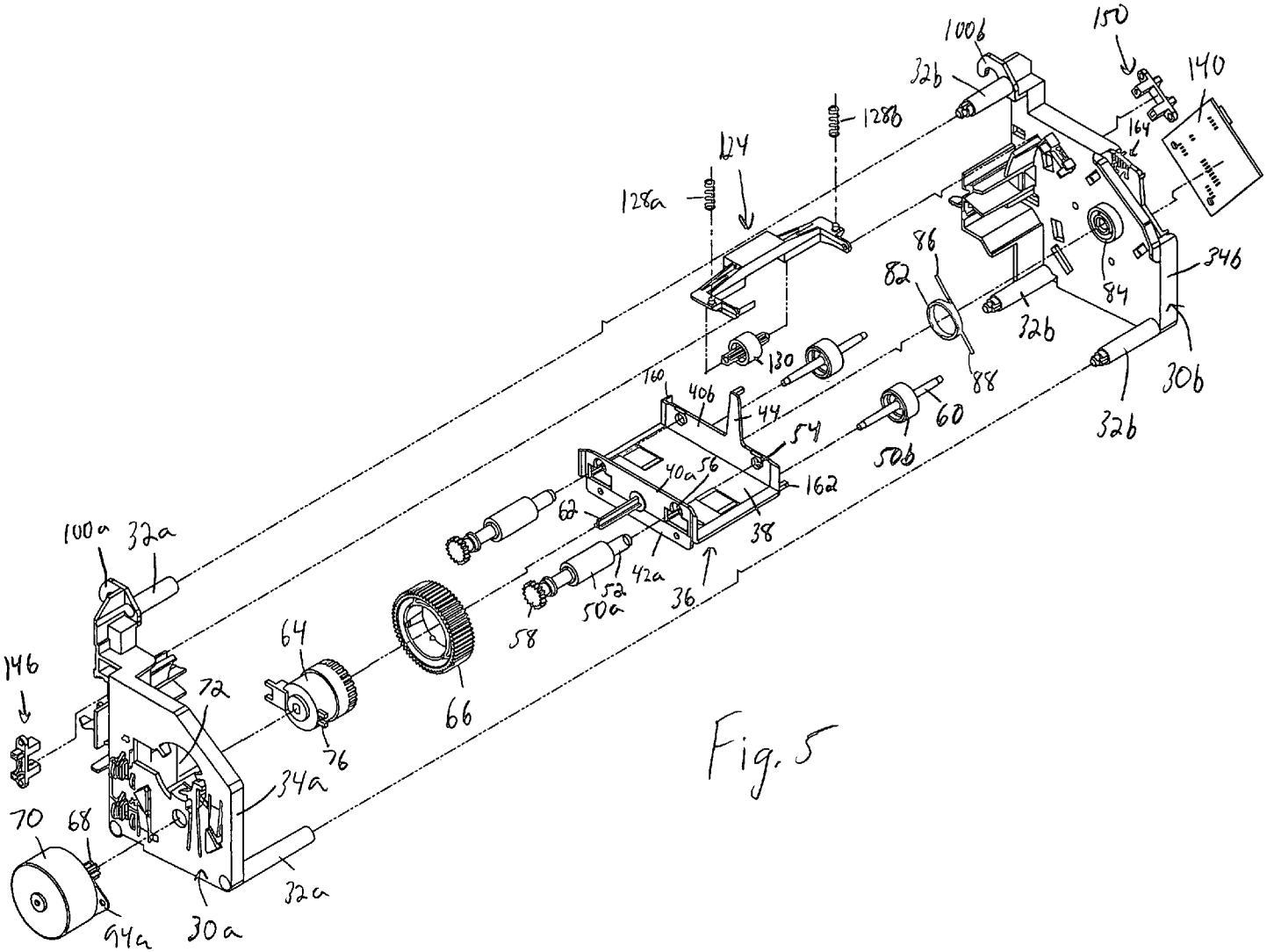
FIG. 5 is an exploded view of the elements forming the reorienting mechanism.
Figure 6:
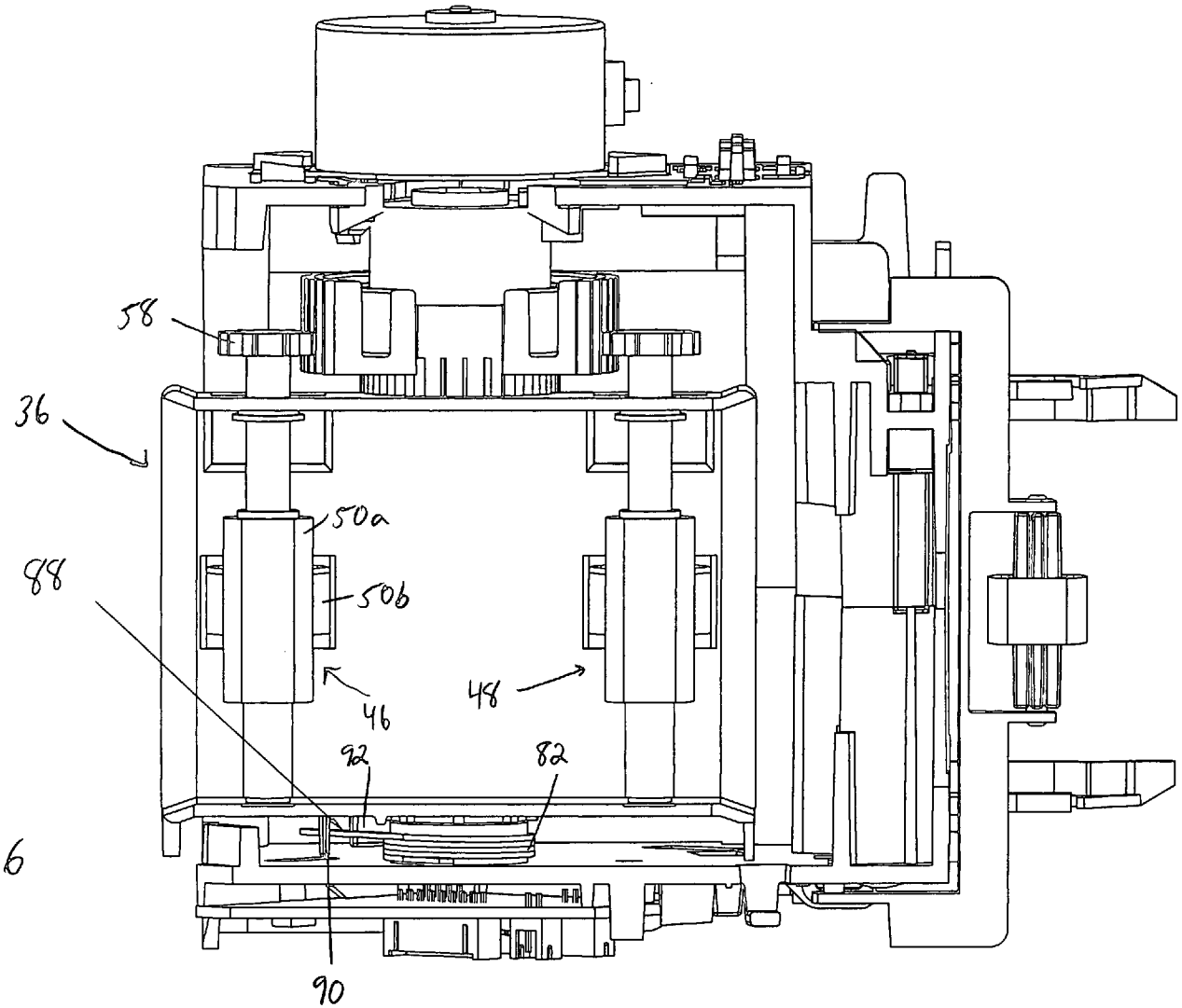
FIG. 6 is a top view of the reorienting mechanism.

As shown in FIG. 6, when the chassis halves 30*a*, 30*b* are connected together, they define therebetween a space that receives a card reorienting device 36 which receives a card to be reoriented and reorients the card. Returning to FIG. 5, the device 36 comprises a platform 38 having an upper surface and an opposite lower surface. A pair of flanges 40*a*, 40*b* extend upwardly from the sides of the platform 38, while a pair of flanges 42*a*, 42*b* extend downwardly from the sides of the platform (the flange 42*b* is not visible in FIG. 5 but is visible in FIG. 11). Further, a calibration arm 44 projects upwardly from the flange 40*b*, as shown in FIG. 5, for a purpose to be later described.

With reference again to FIG. 6, the device 36 further comprises a pair of card transport devices 46, 48 for transporting a card onto the platform 38 from the printer, holding the card while the device 36 reorients the card, and then transports the card from the device 36. The transport devices 46, 48 are identical to each other and only the transport device 46 will be described in detail, it being understood that the transport device 48 operates identically.

The transport device 46 comprises nip rollers 50*a*, 50*b*, each of which is self-loading so as to be able to accommodate cards having different thicknesses. The nip roller 50*a* is formed of a rubber or rubber-like material to permit the roller 50*a* to flex. The roller 50*a* is fixed on a shaft 52, one end of which is rotatably mounted within a hole 54 formed in the flange 40*b* while the other end is rotatably supported in an aperture 56 formed in the flange 40*a* (FIGS. 5 and 6). As shown in FIG. 6, the end of the shaft 52 extends beyond the flange 40*a* and a pinion gear 58 is fixed to the shaft end. In use, the pinion gear 58 is able to be driven to cause rotation of the roller 50*a*.

Figure 11:
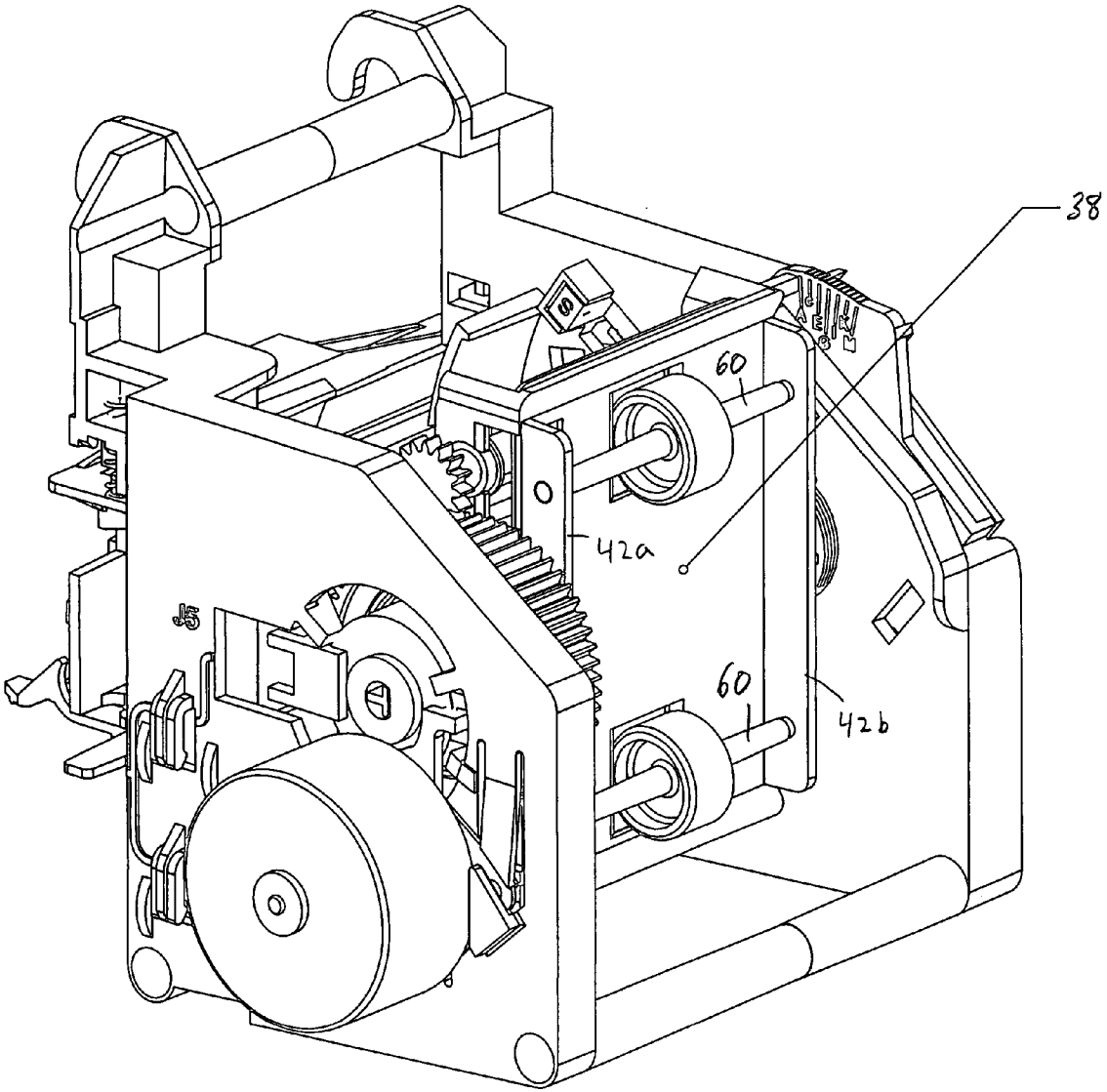
FIG. 11 illustrates the plastic card being reoriented.

On the other hand, the nip roller 50*b* is fixed on a relatively thin, plastic shaft 60 that extends beneath the platform 38. The thickness of the shaft 60 is such as to allow the shaft 60 to flex. The ends of the shaft 60 are rotatably supported within holes formed in the flanges 42*a*, 42*b*, as best seen in FIG. 11. The top of the nip roller 50*b* extends upwardly through a hole 62 formed in the platform 38 and into engagement with the nip roller 50*a*.

The flexing of the rubber of the nip roller 50*a* together with flexing of the shaft 60 of the nip roller 50*b* enables cards of differing thicknesses to enter between the nip rollers 50*a*, 50*b*. The resiliency of the roller 50*a*, and the return force of the shaft 60, force the rollers 50*a*, 50*b* toward one another and maintain sufficient contact force with the card. As a result, the use of springs to accomplish loading of the rollers 50*a*, 50*b* is eliminated.

Returning to FIG. 5, a drive shaft 62 is fixed to and extends from the device 36 proximate the central axis thereof. The shaft 62 forms part of a drive train to cause rotation of the platform 38 about the axis of the shaft 62. Included in the drive train are an electrical clutch mechanism 64 disposed around the shaft 62, a gear 66 surrounding the clutch mechanism 64 and fixed thereto, and a drive pinion 68 that is engaged with the bottom of the gear 66 and that is driven by an electric stepper motor 70 mounted to the plate 34*a*.

In use, when the clutch mechanism 64 is electrically energized, the clutch mechanism 64 is fixed to the shaft 62. Therefore, when the drive pinion 68 is rotated clockwise when viewed from the motor side, the gear 66 is driven which in turn rotates the shaft 62 thereby causing the platform 38 to rotate counterclockwise about the axis of the shaft 62. A wrap spring 82 (to be later described) permits rotation of the platform 38 only in the counterclockwise direction when viewed from the motor side. Because the gear 66 and platform 38 rotate together, the pinion gears 58 remain fixed (i.e. they do not rotate) so that the nip rollers 50*a* do not rotate. As a result, when it is desired to reorient a card that is on the platform, or to return the platform to the position shown in FIG. 10, the clutch mechanism 64 is energized.

In contrast, when the clutch mechanism 64 is deactivated and the drive pinion 68 is rotated in a counterclockwise direction when viewed from the motor side, the gear 66 and clutch mechanism 64 rotate together about the shaft 62 without rotating the shaft 62. This causes the pinion gears 58 to rotate, which causes rotation of the nip rollers 50*a*. As a result, when a card is to be brought onto the platform 38, or driven from the platform, the clutch mechanism 64 is deactivated, so that the nip rollers 50*a* are able to rotate relative to the stationary platform 38. The platform 38 is prevented from rotating in the clockwise direction by the wrap spring 82; otherwise, the friction and torque in the drive system would result in the platform 38 rotating instead of, or in addition to, turning the pinion gears 58. The nip rollers 50*a* are rotated in the same direction for bringing a card onto the platform and to drive a card from the platform, depending on the orientation of the platform 38 (the card can be thought of as coming in the front and exiting out the back, but the platform 38 is flipped when the card exits out the back so it appears to be going forward).

FIGS. 4, 5, 7 and 8 illustrate that the end of the clutch mechanism 64 is disposed within a hole 72 formed in the chassis plate 34*a*. A plurality of ribs 74 formed integrally with the plate 34*a* engage the outer circumference of the clutch mechanism 64 to help stabilize the clutch mechanism. Further, the clutch mechanism 64 includes spaced fingers 76 that define a gap therebetween. A biasing member 78, in this case a finger, is integrally formed with the chassis plate 34*a* and includes an end 80 that fits into the gap defined between the fingers 76 for biasing the clutch mechanism in the direction of the arrow shown in FIG. 8.

With reference to FIGS. 5 and 6, a wrap spring 82 that is separate from the clutch mechanism 64 is provided to limit the rotation of the platform 38 to one direction only. The spring 82 is disposed around a boss 84 formed on the inner surface of the chassis plate 34*b*. One end 86 of the spring 82 is free, while the opposite end 88 of the spring is disposed between two bosses 90, 92 formed integrally with the platform 38. The wrap spring 82 functions as follows. When the platform 38 is rotated in a counterclockwise direction when viewing the mechanism 24 from the motor side as in FIG. 8, the bosses 90, 92 cause the wrap spring to rotate around the boss 84 with the platform. However, when an attempt is made to rotate the platform in the clockwise direction, the engagement between the boss 90 and the end 88 of the spring 82 tends to constrict the wrap spring onto the boss 84. The constriction of the wrap spring 82 onto the boss 84 locks the wrap spring to the boss thereby preventing clockwise rotation of the platform due to engagement between the bosses 90, 92 and the end 88 of the spring.

Figure 7:
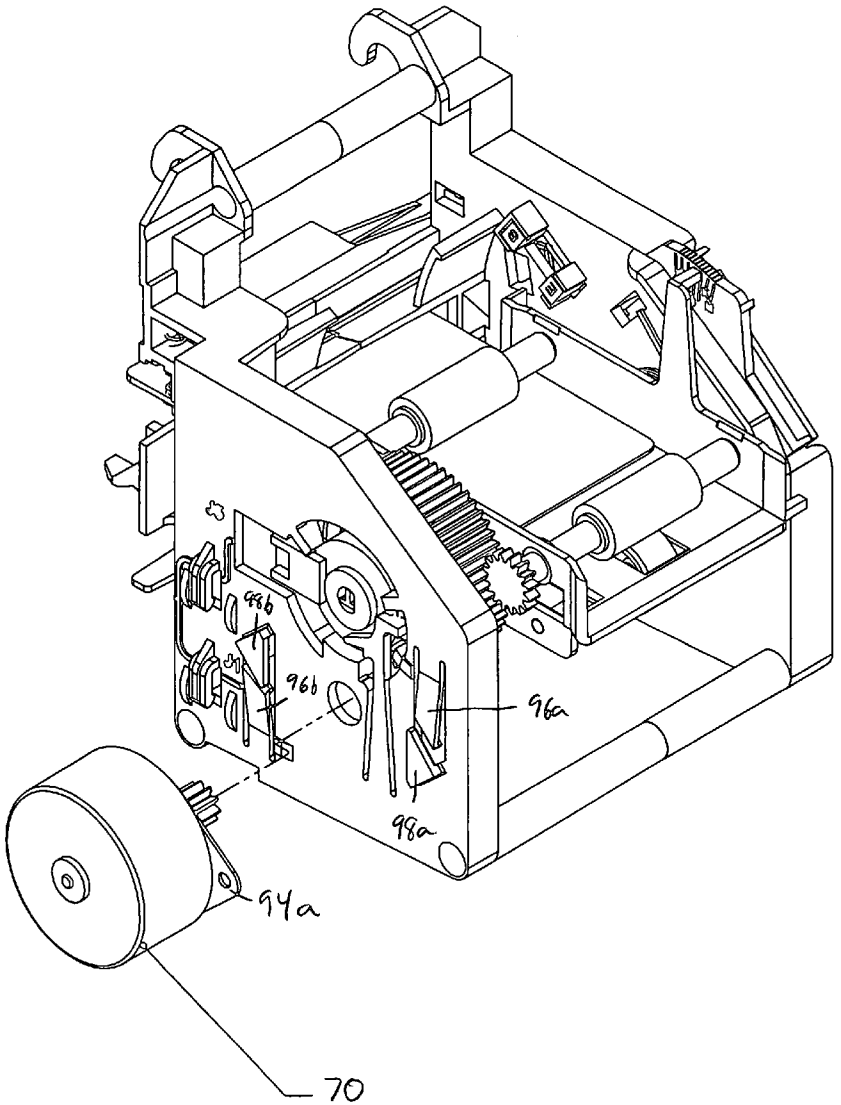
FIG. 7 is a perspective view of the reorienting mechanism illustrating how the motor is attached to the chassis of the reorienting mechanism.
Figure 8:
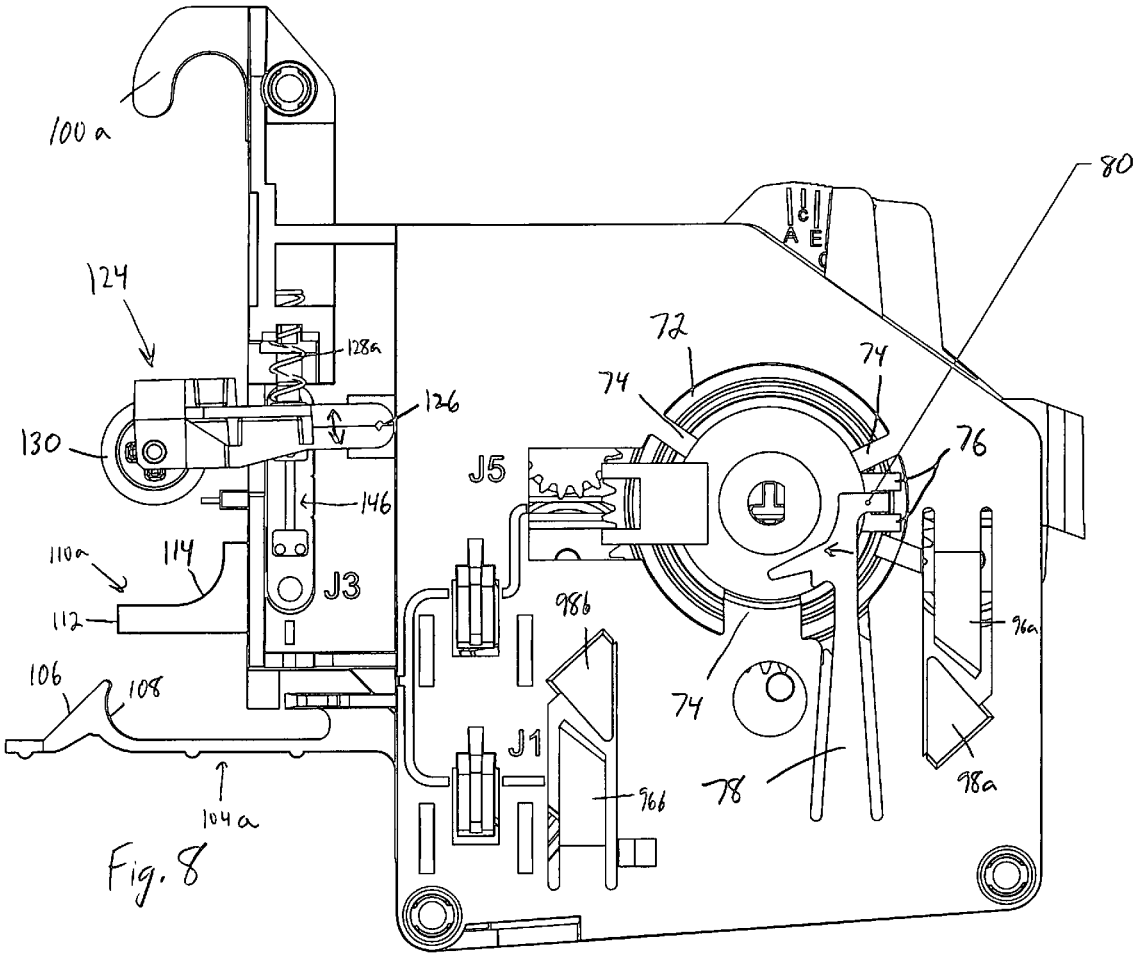
FIG. 8 is a side view of the reorienting mechanism with the motor removed to illustrate the biasing finger.

With reference to FIGS. 5, 7 and 8, the mounting of the electric motor 70 to the chassis plate 34*a* will now be described. The motor 70, which is preferably a stepper motor, includes a pair of tabs 94*a*, 94*b* on opposite sides thereof (the tab 94*b* is visible in FIG. 4). The chassis plate 34*a* includes a pair of integral, resilient flexible ramps 96*a*, 96*b* the outer surfaces of which project slightly beyond the outer surface of the plate 34*a* as shown in FIG. 7. In addition, a pair of flanges 98*a*, 98*b* are formed adjacent to, but spaced from, the end of the ramps 96*a*, 96*b*.

Figure 10:
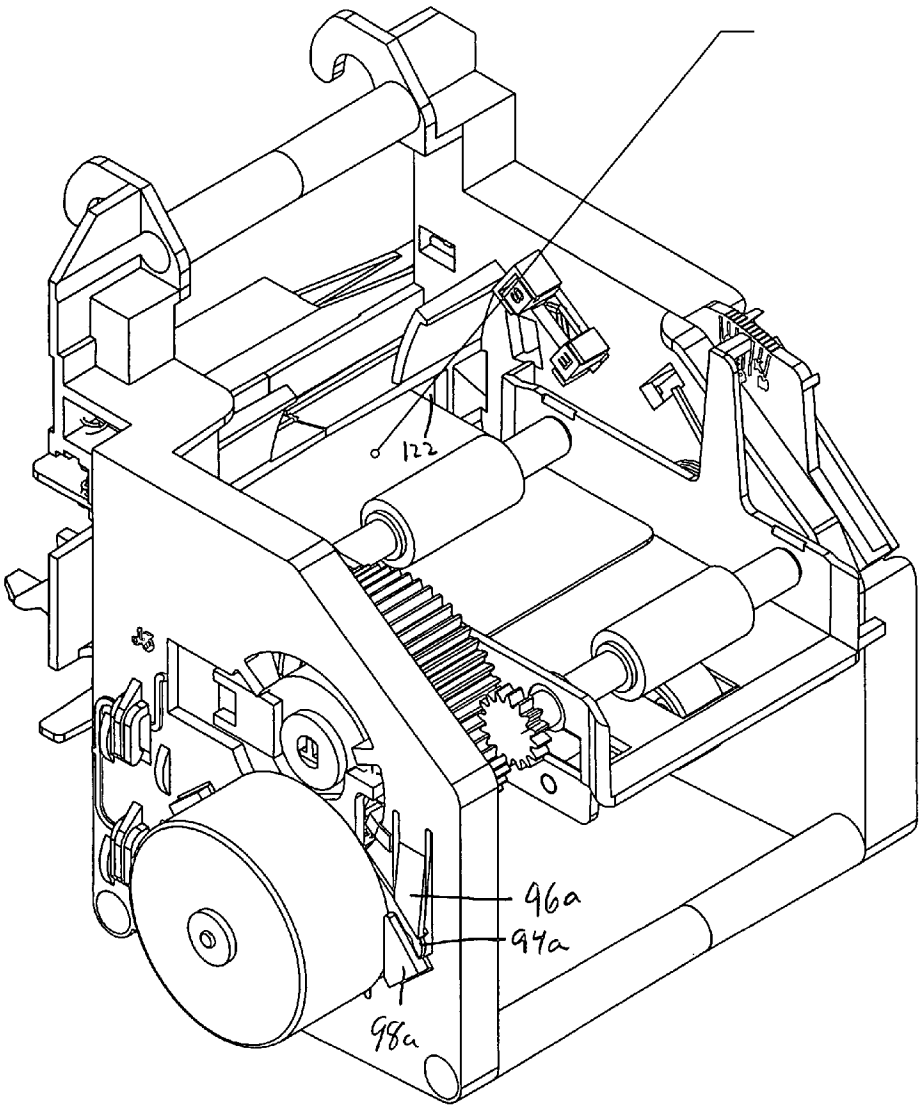
FIG. 10 illustrates a plastic card initially entering the reorienting mechanism.

To connect the motor 70 to the plate 34*a*, the motor 70 is brought toward the plate 34*a* at a slight angle so that the tabs 94*a*, 94*b* are aligned with the ramps 96*a*, 96*b*. The motor 70 is then rotated in a clockwise direction. As this occurs, the tabs 94*a*, 94*b* slide on the ramps 96*a*, 96*b* and force the ramps inwardly. Rotation is continued until the tabs 94*a*, 94*b* slide behind the flanges 98*a*, 98*b*, at which point the ramps 96*a*, 96*b* are able to spring outwardly behind the tabs 94*a*, 94*b* with the ramps 96*a*, 96*b* again projecting slightly beyond the surface of the plate 34*a*. As shown in FIG. 10, the tab 94*a* is held by the flange 98*a*, with the end of the ramp 96*a* locking the tab 94*a* in place behind the flange 98*a*. The tab 94*b* is held in a similar manner. To remove the motor 70, the ramps 96*a*, 96*b* are manually pushed inward, and the motor rotated counterclockwise to effect removal.

The mechanism 24 itself is attached to the rear of the remainder of the printer assembly by a fastenerless mechanism. By avoiding the use of fasteners such as screws, bolts and rivets, assembly of the mechanism 24 into the printer, as well as removal from the printer after installation, is facilitated.

Figure 4:
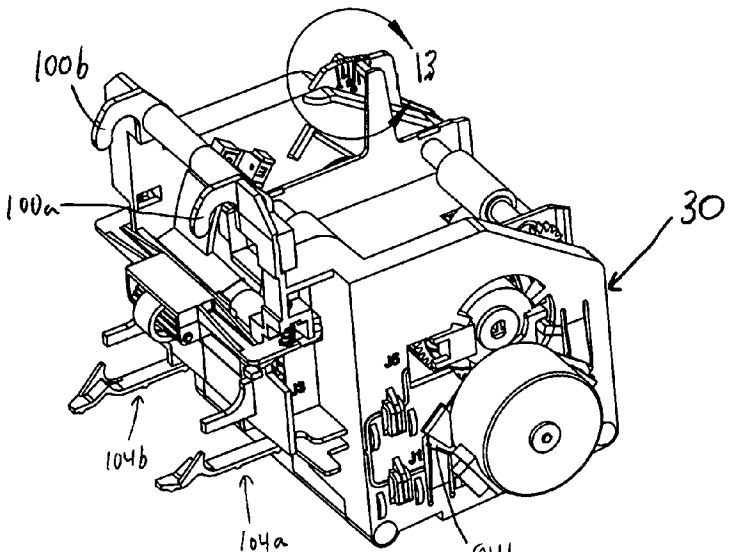
FIG. 4 is a perspective view of the reorienting mechanism.
Figure 9:
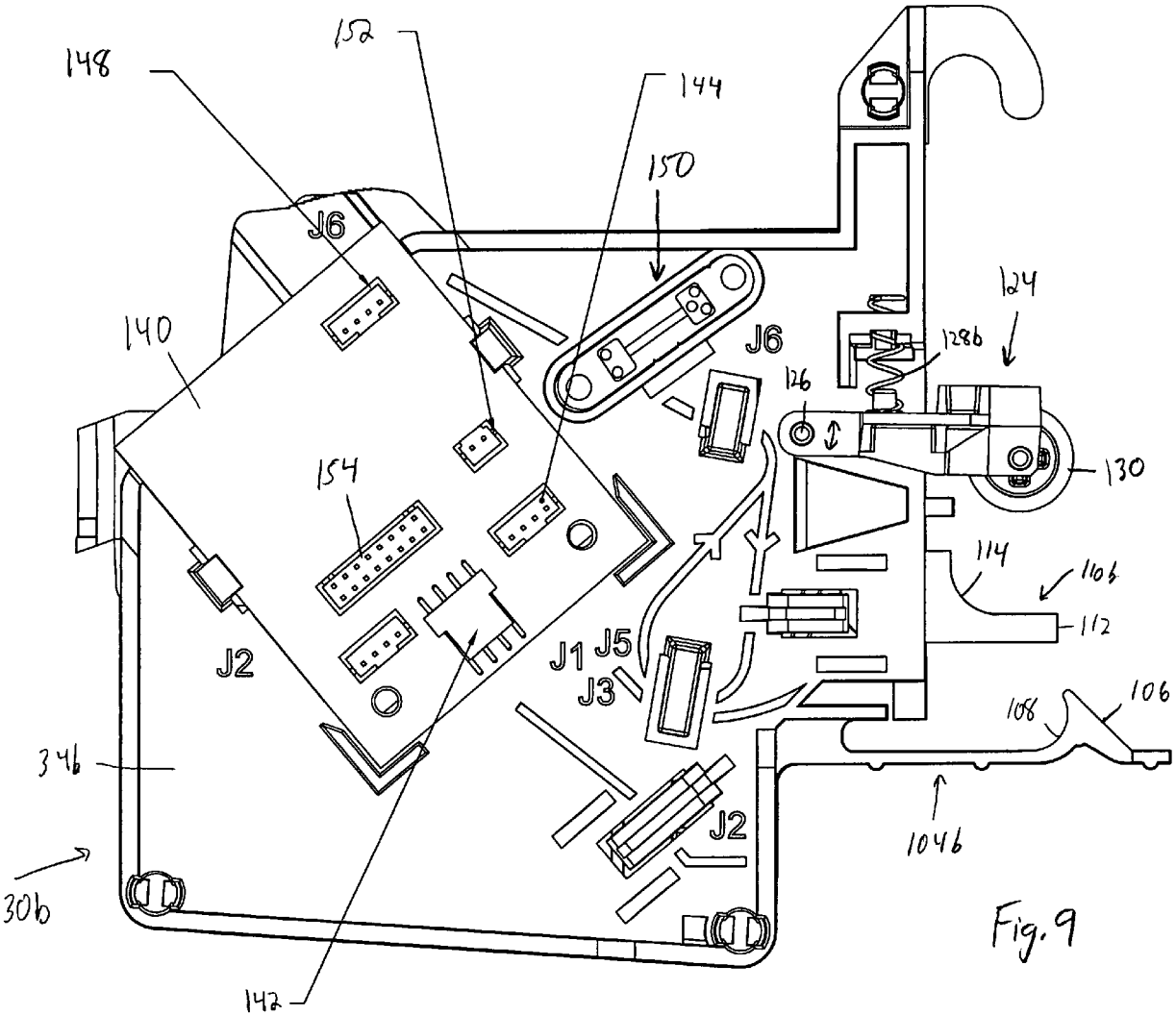
FIG. 9 is another side view of the reorienting mechanism showing the circuit board.

With reference initially to FIGS. 4 and 5, the fastenerless mechanism for attaching the mechanism 24 to the remainder of the printer includes a pair of hooks 100*a*, 100*b* that are integral with the chassis halves 30*a*, 30*b*. The hooks 100*a*, 100*b* are designed to hang on a shaft or post 102 (see FIGS. 2 and 3) within the printer. In addition, a pair of resilient attachment arms 104*a*, 104*b* are integral with the chassis halves 30*a*, 30*b* and project forwardly therefrom. As shown in FIGS. 8 and 9, the end of each arm 104*a*, 104*b* includes an angled ramp section 106 and a curved retention section 108 behind the ramp section 106. In addition, a pair of stops 110*a*, 110*b* project forwardly from the chassis halves 30*a*, 30*b* above the arms 104*a*, 104*b*. Each stop 110*a*, 110*b* includes a planar forward end 112 and a curved section 114.

With the fastenerless mechanism, the mechanism 24 is attached to the remainder of the printer as follows. With reference to FIG. 3, the mechanism 24 is brought to the end of the printer and the hooks 100*a*, 100*b* are hung on the shaft 102 with the mechanism 24 inclined upwardly as illustrated in FIG. 3. The mechanism 24 is then swung downward or clockwise in FIG. 3. As the mechanism 24 is swung downward, the angled ramp sections 106 engage a deflector shaft or post 116. The angle of the ramp sections 106 is selected so as to deflect the free ends of the arms 104*a*, 104*b* downward. As the shaft 116 clears the ramp sections 106, the ends of the arms snap into place in front of the shaft 116, with the curved retention sections 108 engaged with the forward side of the shaft 116 thereby preventing counterclockwise movement of the mechanism 24. As the arms 104*a*, 104*b* are snapping into place, the forward end 112 of the stops 110*a*, 110*b* are coming into engagement with a stop surface(s) 118 in the printer, while the curved sections 114 of the stops 110*a*, 110*b* are coming into engagement with the rear of a shaft housing 120 in the printer.

The fastenerless mechanism formed by the hooks 100*a*, 110*b*, the arms 104*a*, 104*b* and the stops 110*a*, 110*b* serve to attach the mechanism 24 to the remainder of the printer. This attachment scheme is sufficient to retain the mechanism 24 in a front-to-back direction, as well as in a side-to-side direction.

Turning to FIG. 10, a card enters the mechanism 24 through a slot 122 formed in the forward end thereof by the chassis halves 30*a*, 30*b* when they are connected together. As shown in FIGS. 5, 8 and 9, a gate mechanism 124 is pivotally mounted adjacent the slot 122 for pivoting movements up and down about an axis 126. However, a pair of coil springs 128*a*, 128*b* are engaged between fixed structure on the chassis halves 30*a*, 30*b* and the gate mechanism 124 to bias the gate mechanism downward. In addition, an idler roller 130 is rotatably supported on the gate mechanism 124.

Turning to FIG. 3, when the mechanism 24 is mounted to the printer, the idler roller 130 engages the top of a drive roller (not visible in the figures, but rotatably mounted on a shaft houses in the shaft housing 120 in FIG. 3). The engagement between the drive roller and idler roller 130 forces the gate mechanism 124 upward to open the slot 122. The drive roller and idler 130 form a drive roller pair (with the drive roller being driven by a motor) for driving cards into the mechanism 24 and taking cards from the mechanism 24 for transport back toward the printing mechanism. The biasing force of the springs 128*a*, 128*b* is sufficient to maintain adequate engagement forces between the drive roller and idler roller, and the card surfaces.

With reference to FIG. 9, a circuit board 140 is snap fit mounted to the outside surface of the chassis plate 34*b*. The circuit board 140 includes circuitry to control various operations of elements of the mechanism 24. In particular, the circuit board 140 includes a plug-in connector 142 that couples to a motor connector (not shown) for directing electrical power to the motor 70. Further, a plug-in 144 is provided for connection to a photocell 146 (FIG. 8) which senses the entry/exit of cards to/from the mechanism 24, while a plug-in 148 connects to a photocell 150 that senses rotation of the platform 38. In addition, a plug-in 152 connects to the clutch mechanism 64 for controlling operation of the clutch mechanism. A plug-in 154 is connected to a connector (not shown) from the printer 10 which provides power and control signals to the mechanism 24.

The photocell 150 detects rotation of the platform 38 via a plurality of tabs 160, 162 and a finger 166 (to be later described) on arm 44, shown in FIG. 5, connected to the platform. The tabs 160, 162 and finger 166 are positioned to break the photocell beam as the platform rotates. In this manner, the mechanism 24 can track and control the rotation of the platform, and thus control the reorienting of the card. The tabs 160, 162 are used during flipping of the platform, while the finger 166 can be used for 90 degree rotation of the platform.

The mechanism 24 is also provided with a calibration mechanism that is used to calibrate the rotation of the platform 38. In particular, the calibration mechanism is used to achieve a home position for the platform during use of the mechanism 24, where the home position is the position where the platform is substantially horizontal for receiving/discharging a card from the mechanism 24.

Figure 13:
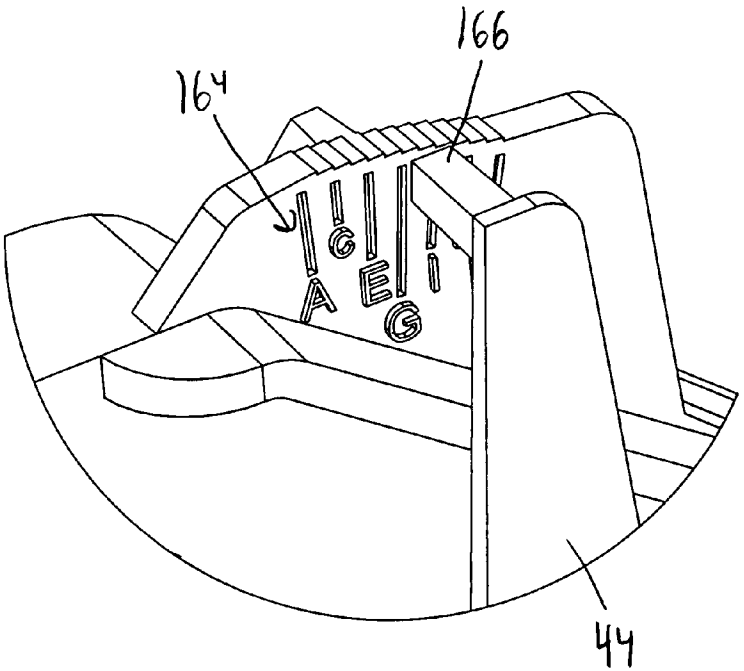
FIG. 13 is a detailed view of the portion contained in the circle 13 in FIG. 4.

The calibration mechanism includes a series of graduations 164 formed on the inner surface of the chassis plate 34*b*, as shown in FIGS. 5 and 13. The calibration mechanism also includes the calibration arm 44 of the platform 38, which arm 44 includes a finger 166 at the end thereof. Upon initial mounting of the mechanism 24 into the printer 10, the platform 38 may not rotate back to its desired home position. Instead, the platform may fall short of its desired home position or it may rotate slightly beyond its home position. The calibration mechanism is designed to remove such errors so that the platform is consistently brought back to its home position.

As an example, with reference to FIG. 13, assume letter G of the graduations to be the desired home position. Ideally, when homed, the finger 166 will align with the graduation mark G. However, the finger 166 could, for example, be aligned with the graduation mark C. If this happens, the platform has rotated beyond its desired home position. If this happens, the printer operator can enter this value "C" into a suitable test program which automatically adjust the printer so that the motor 70 rotates the appropriate fewer number of steps when homing, so that the platform will now be rotated to position "G" when homed. Likewise, if the finger 166 is aligned with mark I, the operator would enter the value "I" into the program which automatically adjusts so that the motor 70 rotates the additional number of steps when homing to bring the platform to its desired home position "G" when homed. This calibration is preferably performed upon initial factory setup of the mechanism 24.

The operation of the reorienting mechanism 24 is as follows. Once the mechanism 24 is mounted in the printer 10 and calibrated, the mechanism 24 is ready to reorient a card. A card is input into the printer 10 from the input hopper assembly 16 and transported to the printing mechanism 15 which performs a printing operation on one side of the card. Once that printing operation is complete, the card is transported to the mechanism 24 and driven into the mechanism by the drive roller/idler roller 130 pair. Entry of the card onto the platform 38 is completed by the transport devices 46, 48 which are rotated by the gear 66. A card entering the mechanism 24 is illustrated in FIG. 10, along with the location of the elements of the mechanism 24.

Figure 12:
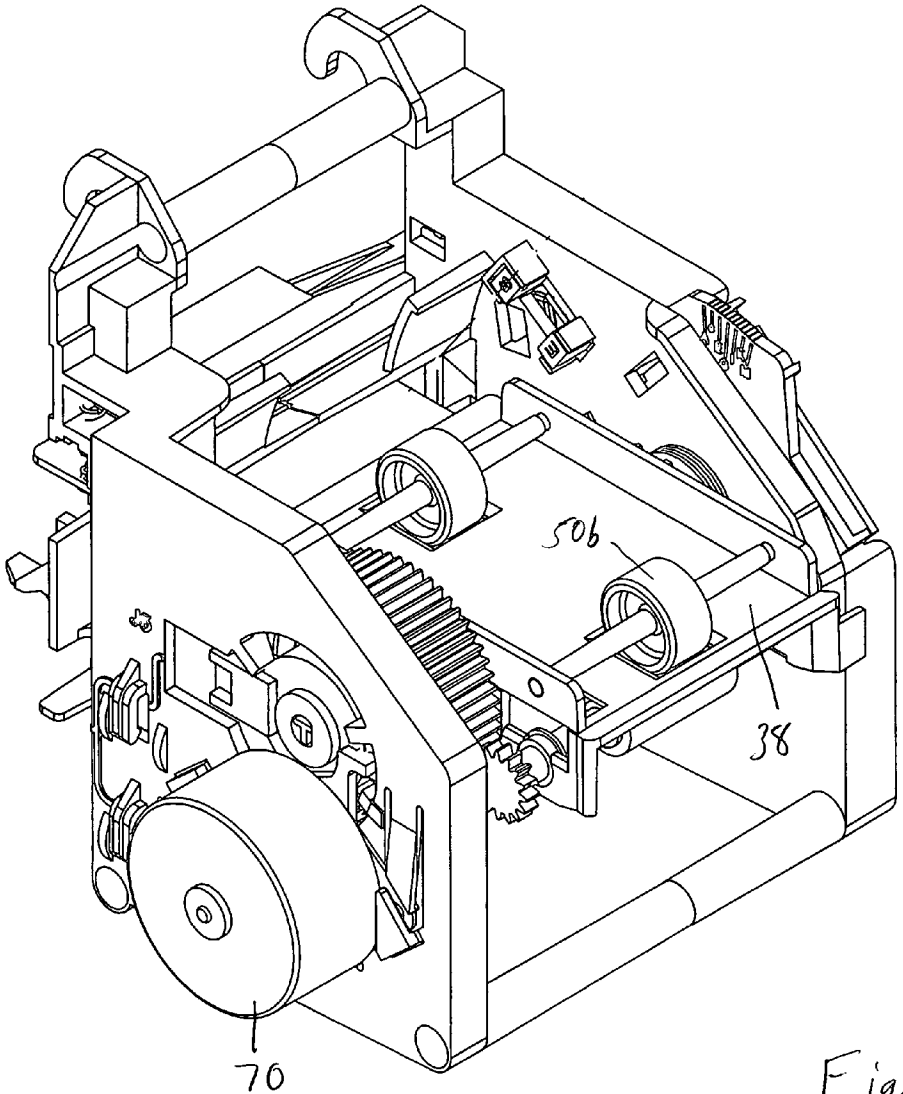
FIG. 12 illustrates the plastic card exiting the reorienting mechanism after being reoriented.

Once the card is fully onto the platform 38, the platform 38 is then rotated to flip the card. FIG. 11 illustrates the platform starting to flip the card. To rotate the platform, the clutch mechanism 64 is energized to lock the clutch mechanism 64 to the platform shaft 62 so that the platform 38 and the gear 66 rotate together. Once the platform has rotated 180 degrees, the card is now flipped and ready to be transported back to the printing mechanism 15 to print on the opposite side of the card. To accomplish this, the clutch mechanism 64 is deenergized, and the transport devices 46, 48 are rotated to drive the card from the platform toward the printing mechanism. A card being driven from the platform is shown in FIG. 12. Because the platform rotates about the axis of the shaft 62, the card when flipped is at the same height as it was when it first entered the mechanism 24 so the card path need not be adjusted. After the now-flipped card is driven from the mechanism 24, the platform is rotated back to its home position, ready to receive another card.

Although the mechanism 24 has been described as flipping a card, the mechanism 24 can be used to reorient a card to whatever direction one desires. For example, a card processing machine could be designed with card processing equipment, such as a chip programmer, positioned beneath the mechanism 24, in addition to the printing mechanism 15. In this example, the card could be reoriented 90 degrees (to the orientation shown in FIG. 11) so as to direct the card to the chip programmer. Once the chip is programmed, the card could be directed back to the printer by the mechanism or directed to other processing equipment. Thus, the mechanism 24 could be utilized as a carousel to direct cards to card processing equipment surrounding the mechanism 24.

Input Hopper Assembly

As indicated above, cards are fed into the printer 10 using the input hopper assembly 16. The input hopper assembly 16 is designed to hold a plurality of cards to be processed, thereby avoiding the need to feed each card by hand into the printer 10. The amount of cards held within the input hopper assembly 16 is usually adequate for most user's needs. However, a user may have a particular print job requiring the printing of a number of cards greater than the number of cards held by the hopper assembly 16. In this instance, the customer may be forced to monitor the card supply in the hopper assembly, and replenish the cards as they run low in order to complete the print job. This need to monitor the card supply takes the person away from doing other tasks.

To avoid such occurrences, the input hopper assembly 16 is designed as part of an interchangeable input hopper system which permits a user to replace one input hopper assembly with another input hopper assembly that holds a different number of cards. Either the entire input hopper assembly can be replaced with another input hopper assembly, or a portion of the input hopper assembly can be replaced with a replacement portion which expands the card capacity of the input hopper assembly.

Figure 14:
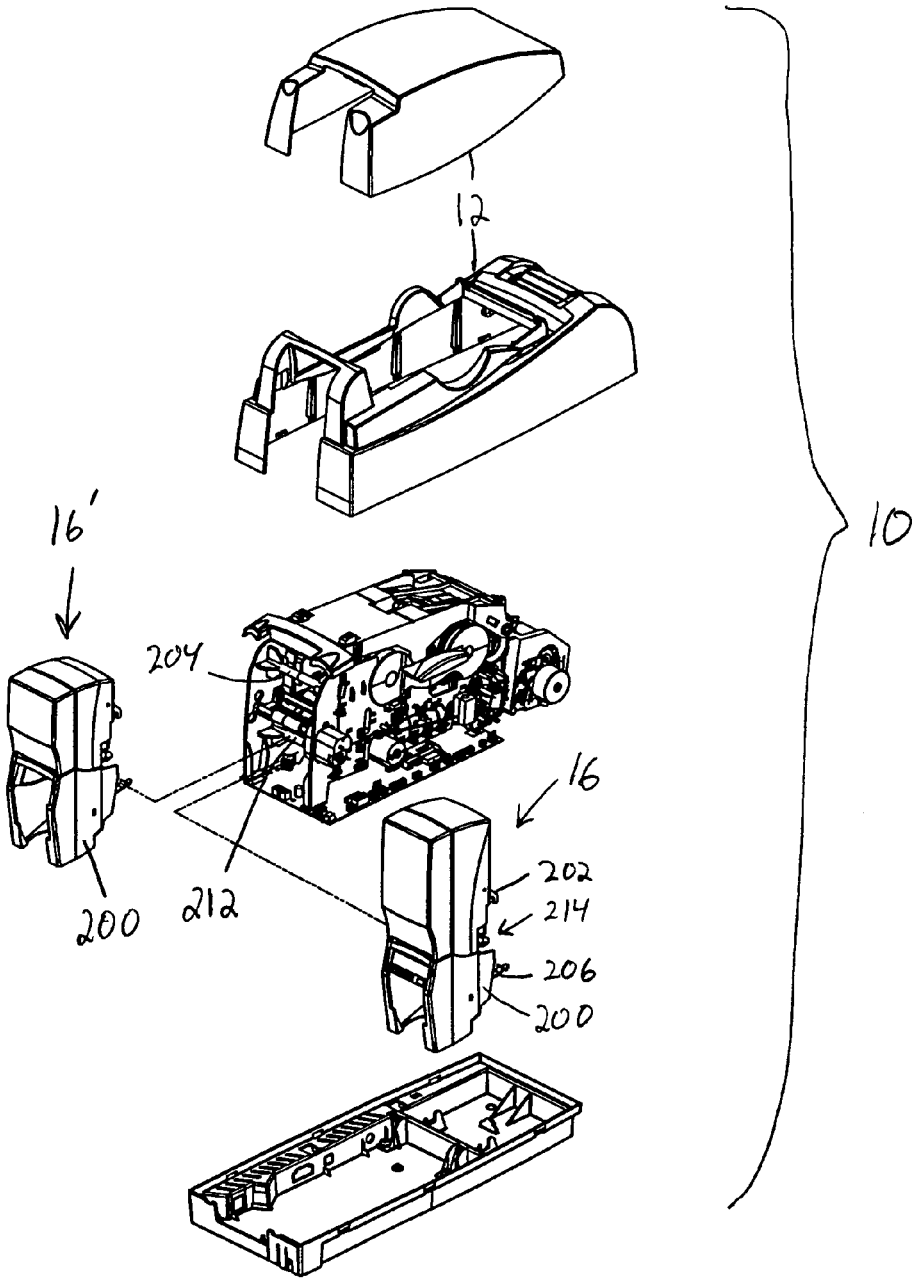
FIG. 14 illustrates one implementation of the interchangeable input hopper system.

Turning now to FIGS. 14-20, the interchangeable hopper assembly concept will be described. FIG. 14 illustrates one version of the concept, where one input hopper assembly 16 is designed to hold one predetermined number, for example 200, of CR80 sized cards, while a second input hopper assembly 16' is designed to hold a second predetermined number, for example 100, of CR80 sized cards. Both input hopper assemblies 16, 16' are designed to be useable with the printer 10 and both can be mounted for use without altering the printer.

Each input hopper assembly 16, 16' is also illustrated as including an integral output hopper 200 into which printed cards are deposited. However, it is to be realized that the output hopper 200 could be separate from the input hopper assemblies 16, 16'.

The input hopper assemblies 16, 16' are each designed to mount to the printer 10 in a similar manner. Therefore, only the mounting of the assembly 16 will be described in detail, it being realized that the assembly 16' mounts to the printer 10 in an identical manner.

Figure 15:
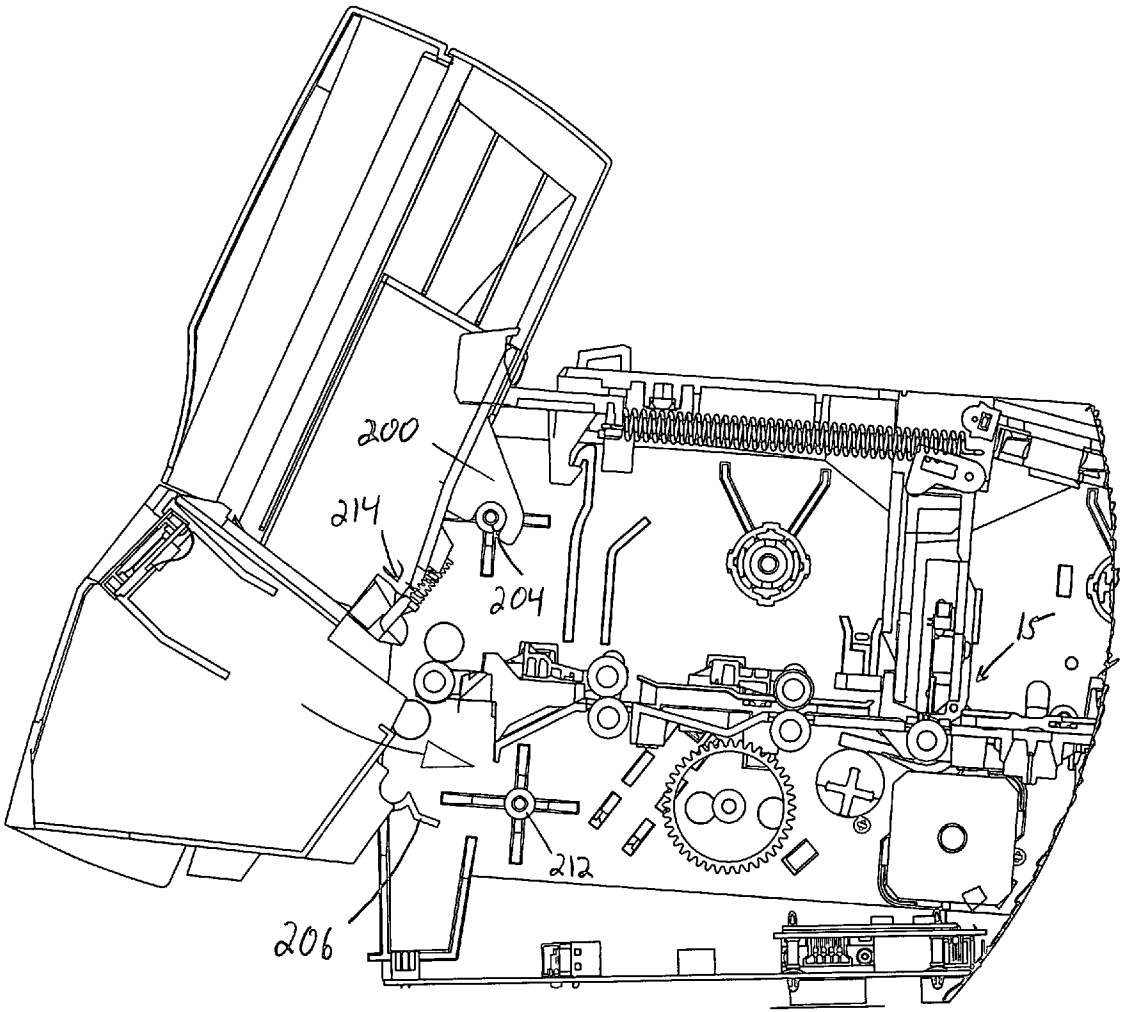
FIG. 15 illustrates how the input hopper assembly connects to the printer.
Figure 16:
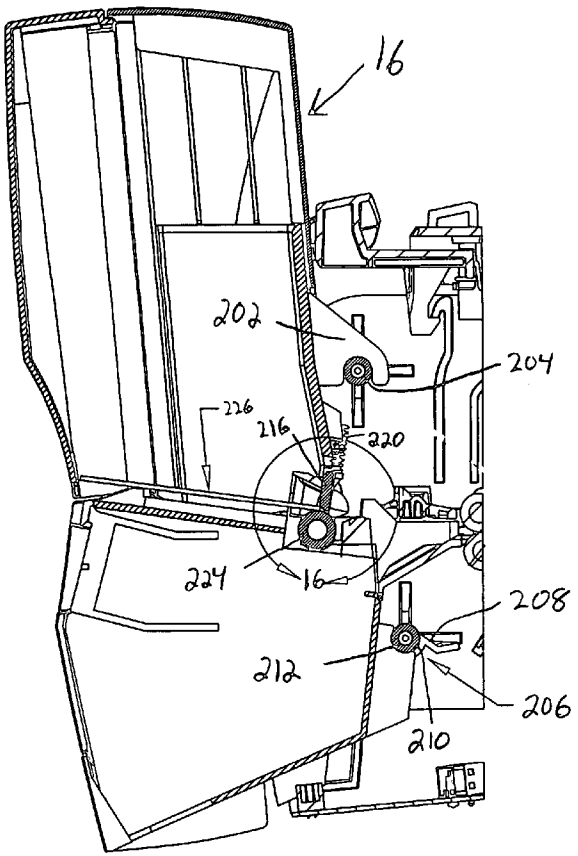
FIG. 16 illustrates how a card is picked from the input hopper assembly.
Figure 20:
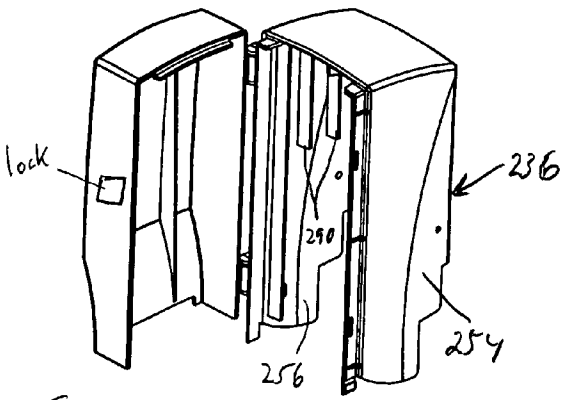
FIG. 20 illustrates an input hopper shell that is attachable to the hopper chassis for expanding the size of the input hopper.

With reference to FIGS. 14-16, the assembly 16 includes a pair of hooks 202 connected to the back side thereof. Only one hook 202 is visible in the Figures. The hooks 202 are spaced apart from each other and are designed to hook onto a shaft 204 adjacent the front end region 20 of the printer 10. In addition, a pair of resilient arms 206 are connected to the back side of the output hopper 200. Only one arm 206 is visible in the Figures. The arms 206 are constructed similarly to the arms 104*a*, 104*b* of the mechanism 24, in that the arms 206 each include an angled ramp section 208 and a curved retention section 210. The arms 206 are designed to snap-fit connect with a shaft 212 adjacent the front end region 20 of the printer 10.

To connect the assembly 16 to the printer 10, the printer housing 12 is removed, and the hooks 202 are hung on the shaft 204 with the hopper assembly 16 angled as illustrated in FIG. 15. The assembly 16 is then swung downward or counterclockwise in FIG. 15 in the direction of the arrow. As the assembly 16 is swung downward, the angled ramp sections 208 engage the shaft 212. The angle of the ramp sections 208 is selected so as to deflect the free ends of the arms 206 downward. As the shaft 212 clears the ramp sections 208, the ends of the arms snap into place behind the shaft 212, with the curved retention sections 210 engaged with the rear side of the shaft 212 thereby preventing clockwise movement of the assembly 16. The housing 12 is then mounted back in position and the printer is ready for use.

Each assembly 16, 16' also includes a gate mechanism 214 that controls the picking of cards from the assembly 16, 16'. The gate mechanisms 214 in each assembly 16, 16' are identical. Therefore, only the gate mechanism 214 for the assembly 16 will be described in detail, it being realized that the gate mechanism for the assembly 16' is identical.

Figure 17:
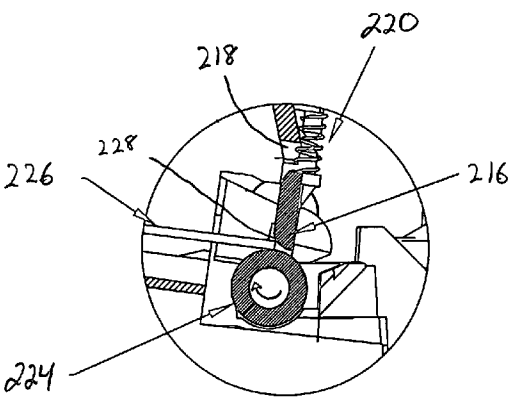
FIG. 17 is a detailed view of the portion contained in the circle 17 in FIG. 16.
Figure 19:
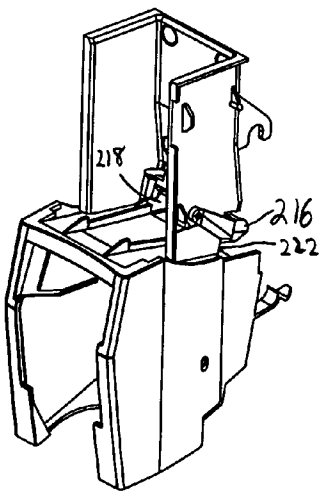
FIG. 19 illustrates the output hopper shell connected to the chassis of the input hopper assembly.
Figure 18:
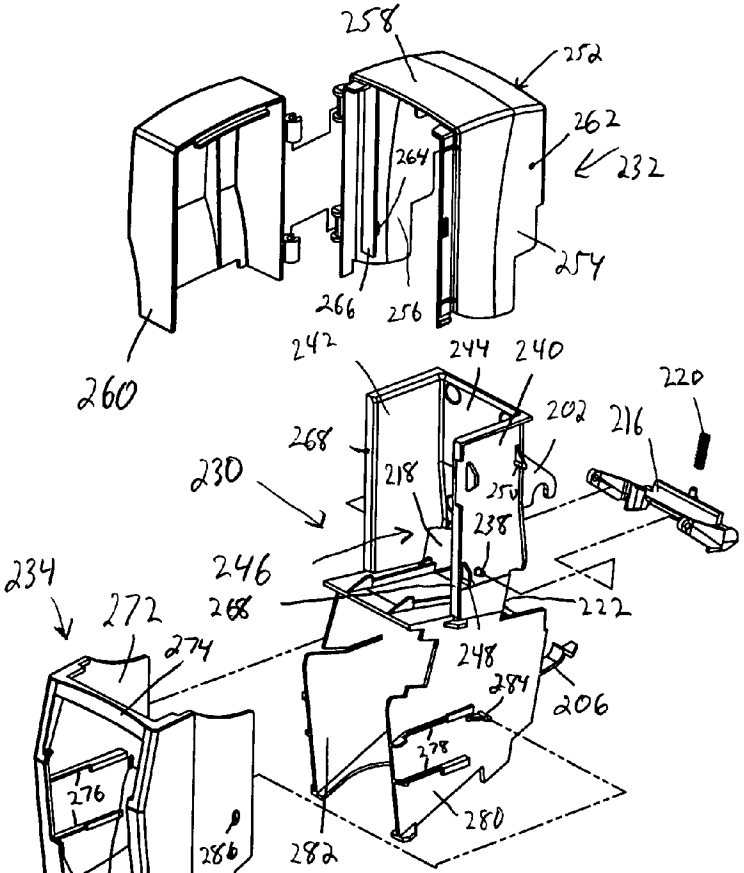
FIG. 18 illustrates the individual elements of one input hopper assembly.

Referring to FIGS. 16 and 17, the gate mechanism 214 comprises a gate 216 that is pivotally mounted at the rear of the assembly 16. The gate 216 is disposed within a slot 218 that is formed through the rear of the assembly 16 and through which cards exit the assembly 16. The gate 216 is biased downward by a spring 220 that extends between the gate 216 and fixed structure of the assembly 16. As best seen in FIGS. 18 and 19, downward movement of the gate 216 is limited by engagement between the gate and sides 222 of the assembly 16 that form the slot 218.

As shown in FIGS. 16 and 17, when the assembly 16 is mounted in position, the gate 216 is disposed above a pick roller 224 within the printer. The pick roller 224 is rotatable by a suitable drive motor (not shown) to pick a card from the hopper assembly 16. FIGS. 16 and 17 illustrate a card 226 ready to be picked. As the pick roller 224 rotates in the direction of the arrow in FIG. 17, the front edge of the card 226 is pinched between an angled surface 228 of the gate 216, which is biased by the spring 220, and the pinch roller 224. This causes the gate 216 to lift upward and the card 226 to advance into the printer 10.

FIG. 18 illustrates details of the hopper assembly 16', as well as an alternative method of implementing an interchangeable input hopper system through the use of interchangeable hopper shells. The assembly 16' includes a hopper chassis 230, an input hopper shell 232 detachably connectable to the chassis 230 and an output hopper shell 234 detachably connectable to the chassis 230. The input hopper shell 232 is connected to the chassis 230 when a user wants to hold a maximum of, for example, 100 CR80 sized cards. Alternatively, to hold a larger number of CR80 sized cards, for example 200 cards, the input hopper shell 232 can be removed and replaced with an input hopper shell 236 shown in FIG. 20.

As shown in FIG. 18, the chassis 230 defines the slot 218, rotatably supports the gate 216 via integral pins 238 formed on the chassis 230, and is integrally formed with the hooks 202 and arms 206. The chassis 230 includes a pair of upper side walls 240, 242, and an upper, rear wall 244 which together define a card receiving area 246. Further, each upper side wall 240, 242 of the chassis 230 is formed with locking projections 248, 250 on the outer surface thereof (only one set of locking projections is visible in the Figures).

The input hopper shell 232 comprises a main housing 252 formed by side walls 254, 256, a top wall 258 and a partial rear wall (not visible) which together define an open area. A door 260 is pivotally connected to the side wall 256 for controlling access to the open area. Each side wall 254, 256 includes means for locking engagement with the locking projections 248, 250 of the chassis 230. In particular, the each side wall 248, 250 includes an aperture 262 that snap fit connects with the locking projections 250, while each side wall 254, 256 includes a channel 264 that snap fit connects with the lock projections 248. Further, each side wall 254, 256 includes a flange 266 (only one flange is visible in the figures) that slides in front of a corresponding flange 268 formed on the sides 240, 242 of the chassis 230.

Similarly, the output hopper shell 234 comprises a pair of side walls 270, 272 that are interconnected by bridge 274. The side walls 270, 272 each include a pair of spaced ribs 276 on the inner surface thereof. The chassis 230 includes a pair of spaced ribs 278 on a pair of lower side walls 280, 282. The front ends of the ribs 278 are angled toward each other to act as a guide for the ribs 276 on the side walls 270, 272 of the shell 234. Further, the lower side walls 280, 282 each also include a locking projection 284, while the side walls 270, 272 of the shell 234 each include an aperture 286 that receive the locking projections 284.

The hopper assembly 16' is formed by attaching the output hopper shell 234 to the lower end of the chassis 230. The shell 234 is brought toward the chassis 230 so that the ribs 276 are above and below the ribs 278. The shell 234 is then pushed onto the chassis 230 until the locking projections 284 snap into the apertures 286. FIG. 19 illustrates the output hopper shell 234 mounted on the chassis 230.

The input hopper shell 232 is then attached to the chassis 230 by bringing the shell 232 down from above the chassis 230. The shell 232 and chassis 230 should be aligned such that the flanges 266 on the shell 232 are in front of the flanges 268 on the chassis 230. One continues to push the shell 232 onto the chassis 230 until the locking projections 250 snap fit into the apertures 262 and the locking projections 248 snap fit into the channels 264.

When attached, the partial rear wall of the shell 232 will be behind the rear wall 244 of the chassis 244. Further, the walls of the chassis 230, the top wall of the shell 232 and the door will define a compartment sufficient to hold a predetermined number of cards, for example 100 CR80 sized cards.

The capacity of the input hopper can be increased by replacing the shell 232 with the shell 236. The shell 236 is similar in construction to the shell 232, but is larger vertically to accommodate more cards. In addition to the details described for the shell 232, the shell 236 also includes ribs 290 on the side walls 254, 256. The ribs 290 extend inwardly to help define a card receiving area of sufficient size when the shell 236 is mounted on the chassis 230. When the shell 236 is attached, the bottom end of the ribs 290 will be disposed adjacent the top of the chassis 230.

The shell 236 attaches to the chassis 230 is the same manner as the shell 232. However, when the shell 236 is used, the shell 236 and chassis 230 will define a compartment sufficient to hold a larger predetermined number of cards, for example 200 CR80 sized cards.

Therefore, by either replacing the entire hopper assembly with a new hopper assembly, or by replacing one input hopper shell for another input hopper shell, the card holding capacity of the input hopper can be changed.

All components of the input hopper assemblies 16, 16' are preferably made of plastic, expect for the spring 220. However, a variety of materials could be used in place of, or in combination with, plastic.

The above specification, examples and data provide a complete description of the invention. Many embodiments of the invention, not explicitly described herein, can be made without departing from the spirit and scope of the invention.

What is claimed is:

1. A modular card reorienting mechanism for use in a card processing machine, comprising:

a chassis including a fastenerless mechanism for detachably connecting the chassis to the card processing machine;

an electric motor mounted on the chassis;

a card reorienting device rotatably mounted on the chassis, wherein the card reorienting device comprises a platform with a pair of card transport devices, the transport devices being actuatable by the electric motor; and a drive train between the electric motor and the card reorienting device whereby the electric motor is able to rotate the card reorienting device.

2. The modular card reorienting mechanism of claim 1, wherein the fastenerless mechanism comprises a snap-fit connection system.

3. The modular card reorienting mechanism of claim 1, wherein the chassis, the electric motor, the card reorienting device and the drive train form a fastenerless assembly.

4. The modular card reorienting mechanism of claim 1, wherein the card transport devices each comprise nip rollers that are self-loading.

5. The modular card reorienting mechanism of claim 1, further comprising a circuit board mounted on the chassis.

6. A modular card reorienting mechanism for use in a card processing machine, comprising:

a chassis including a fastenerless mechanism for detachably connecting the chassis to the card processing machine;

an electric motor mounted on the chassis;

a card reorienting device rotatably mounted on the chassis; and a drive train between the electric motor and the card reorienting device whereby the electric motor is able to rotate the card reorienting device, wherein the drive train includes a clutch mechanism, and further comprising a wrap spring separate from the clutch mechanism that is connected to the card reorienting device and that is configured to provide one-way rotation of the card reorienting device.

7. The modular card reorienting mechanism of claim 6, further comprising a member integrally formed with the chassis that is engaged with the clutch mechanism to apply a biasing force to the clutch mechanism.

8. A modular card reorienting mechanism for use in a card processing machine, comprising:

a chassis including a fastenerless mechanism for detachably connecting the chassis to the card processing machine;

an electric motor mounted on the chassis;

a card reorienting device rotatably mounted on the chassis;

a drive train between the electric motor and the card reorienting device whereby the electric motor is able to rotate the card reorienting device; and a calibrating mechanism for calibrating rotation of the reorienting device.

9. A modular card reorienting mechanism for use in a card processing machine, comprising:

a chassis;

an electric motor mounted on the chassis;

a card reorienting device rotatably mounted on the chassis, wherein the card reorienting device comprises a platform with a card transport device, the transport device being actuatable by the electric motor; and a drive train between the electric motor and the card reorienting device whereby the electric motor is able to rotate the card reorienting device;

wherein the chassis, the electric motor, the card reorienting device and the drive train form a fastenerless assembly.

10. The modular card reorienting mechanism of claim 9, wherein the chassis is configured to snap-fit connect to the card processing machine.

11. The modular card reorienting mechanism of claim 9, further comprising a circuit board mounted on the chassis.

12. A modular card reorienting mechanism for use in a card processing machine, comprising:

a chassis including a fastenerless mechanism for detachably connecting the chassis to the card processing machine;

an electric motor mounted on the chassis;

a card reorienting device rotatably mounted on the chassis; and a drive train between the electric motor and the card reorienting device whereby the electric motor is able to rotate the card reorienting device, wherein the fastenerless mechanism comprises:

a hook connected to the chassis and extending forwardly therefrom that is configured to engage with a post on the card processing machine by which the card processing mechanism can be rotatably hung adjacent a rear end of the card processing machine; and a resilient arm connected to the chassis and extending forwardly therefrom that is configured to detachably engage with a post on the card processing machine.

13. The modular card reorienting mechanism of claim 12, comprising a pair of said hooks and a pair of said resilient arms.

14. The modular card reorienting mechanism of claim 12, further comprising a stop connected to the chassis and projecting forwardly therefrom.

* * * * *